US006955617B1

(12) United States Patent
Boren et al.

(10) Patent No.: US 6,955,617 B1
(45) Date of Patent: Oct. 18, 2005

(54) TENNIS NET CENTER STRAP FOR MEASURING AND HOLDING NET AT CERTAIN HEIGHT

(75) Inventors: Mark Edelman Boren, Wilmington, NC (US); Lawrence Christopher Williams, 208 Macon Smith, Willard, NC (US) 28478

(73) Assignee: Lawrence Christopher Williams, Wilmington, NC (US)

( * ) Notice: Subject to any disclaimer, the term of this patent is extended or adjusted under 35 U.S.C. 154(b) by 0 days.

(21) Appl. No.: 10/921,280

(22) Filed: Aug. 19, 2004

(51) Int. Cl.[7] ..... A63B 61/04
(52) U.S. Cl. ..... 473/495
(58) Field of Search ..... 473/490, 491, 473/494, 495; 273/DIG. 30; 24/306, 90.1, 24/379.1, 300–302, 442

(56) References Cited

U.S. PATENT DOCUMENTS 1,534,447 A * 4/1925 Hardy ..... 473/495
4,247,099 A * 1/1981 Pandak ..... 473/474
4,671,509 A * 6/1987 Newman ..... 473/495
4,973,055 A * 11/1990 Muir ..... 473/495
6,449,815 B1 * 9/2002 Spiller ..... 24/306
6,868,619 B1 * 3/2005 Boren et al. ..... 33/760

* cited by examiner

*Primary Examiner*—Raleigh W. Chiu

(57) ABSTRACT

A tennis net strap designed for professional tour-level applications that both measures and securely holds center of tennis net at regulation height above court is described. Strap is of minimally stretching material and employs "hidden" buckle system and hook and loop swatches. A sewn measuring mark indicates when strap is fastened at correct height. On measurement end of strap, a tab keeps strap end clean and from fraying. A single-end snap clip anchors strap to court. Both sides of the installed strap are fastened together through net to integrate strap with net and avoid false "let" calls made by electronic vibration or optical monitors. All fasteners are internal to the installed strap; no distracting buckles are visible, so the appearance of the strap is that of a clean, white line.

1 Claim, 4 Drawing Sheets

TENNIS NET CENTER STRAP FOR MEASURING AND HOLDING NET AT CERTAIN HEIGHT

CROSS REFERENCE TO RELATED APPLICATIONS

Not Applicable.

STATEMENT REGARDING FEDERALLY SPONSORED RESEARCH OR DEVELOPMENT

Not applicable.

REFERENCE TO SEQUENCE LISTING, A TABLE, OR A COMPUTER PROGRAM LISTING COMPACT DISK APPENDIX

Not applicable.

BACKGROUND OF THE INVENTION

The present invention is a part of tennis net sporting equipment generally, and specifically relates to permanent and portable devices and straps for adjusting and maintaining the regulation height of a tennis net.

| | |
|---|---|
| Current U.S. Class: | 473/495; 24/625 |
| Intern'l Class: | A63B 061/00 |
| Field of Search | 273/29 BA 24/627, 628, 629, 630, 631, 632, 634, 635, 636 |

References cited:

U.S. Patent Documents:

| | | | |
|---|---|---|---|
| 1239924 | September 1917 | Lord | 273/29. |
| 1351066 | August 1920 | Robinson | 273/29. |
| 140997 | March 1920 | Vaile | 273/29. |
| 1534447 | April 1925 | Hardy | 273/29. |
| 3549146 | December 1970 | Davis | 273/29. |
| 4247099 | January 1981 | Pandak | 273/29. |
| 4671509 | June 1987 | Newmann | 273/29. |
| 4831694 | May 1989 | Kong | 24/635. |
| 4973055 | November 1990 | Muir | 273/29. |

Foreign Patent Documents:

| | | | |
|---|---|---|---|
| 190006 | December 1922 | GB | 273/29. |
| 344615 | March 1931 | GB | 273/29. |
| 516402 | January 1940 | GB | 273/29. |
| 2138879 | October 1984 | GB | 24/634. |

A vertical net suspended by a metal cable bisects a tennis court into two equal playing areas. The net and cable are connected to posts (approx. 40 inches) that are taller than the regulation height stipulated for the center of the net (currently 36 inches) during actual play. In preparing the court for play, the cable and net are pulled taut between the two posts and then a net strap anchored to the court surface adjusts the center of the net downward to regulation height and attempts to hold it there. The maintenance of the net at the prescribed height is crucial for fair play, with the slightest variance potentially having a profound impact on the scoring and outcome of a given tennis match. Serious players often carry tape measures to matches with them and spend a great amount of time-both prior to and during play-trying to adjust extant net straps to bring the net to the correct height. In professional matches, the net height is checked periodically by the umpire during a match.

Many forms of net strap exist and a number of different devices have been proposed to correctly measure and maintain tennis nets at the correct height. Muir U.S. Pat. NO. 4,973,055) describes a net strap with an integral measuring system in which two pieces of strapping material are fastened to the court anchor by a double-ended snap hook. One of the straps has a serrated-edge buckle, through which the other strap is fed before it is folded down upon itself and attached to itself by means of hook and loop material. A sliding, interwoven measuring tape device is integral to the net strap and is adequate for measuring the net to the correct height; however, the strap itself does not maintain the net at the correct height over moderate to long periods of time. The buckle system does not sufficiently hold and the serrated edge in the buckle actively degrades the strap material. The sliding, interwoven measuring tape has a "different looks to it that can be distracting, making it unsuitable for professional "tour-level" applications. And importantly, the use of a potentially distracting, visible buckle on a strap made for the center of a court is less than desirable for professional applications. Finally, when the strap is installed, the two parallel bands of the strap (one running on each side of the net) do not interlock through the net; thus the net and net strap are not fully integrated with one another. An important problem facing the professional circuit today is that due to the strap and the net remaining thus distinct, the electronic "let" monitoring devices employed sometimes gives false "let" calls (due, for example, to even a mild wind vibrating the net strap) thus interrupting play, potentially changing the outcome of a point, and in the worst-case scenario altering the outcome of a match. (A "let" is when a served ball touches the net before landing in the opposite court, resulting in the suspension of match play and the serve having to be repeated. The accuracy of a "let call" is of vital important to the professional game, so much so, that electronic vibration monitors, optical devices, and microphones are used alongside human monitors to detect a ball brushing the top of a net.)

Pandak (U.S. Pat. No. 4,247,099) offers another net strap with an integral measuring device comprising a single strap passed through a snap hook with a set of interlocking rings or a Velcro fastener close to each end. The strap is passed over the net and the ends attached to one another. The net is at the correct height when one end of the strap touches the ground and an indicator mark is visible on the top of the net. This simple device correctly measures the net height while the strap is new, but the device has a few major problems. The free (measuring) end of the strap can abrade with time and become frayed during match play (thus negating its usefulness in measuring the correct height of the net); and more importantly, neither the rings not the Velcro sufficiently holds the strap in place. Tennis balls hitting the net cable loosen the Velcro and cause the described simple ring devices to slip, even under recreational play. The fastening systems of Pandak's design are simply inadequate to secure the net at the correct height under the extreme net cable tensions employed by the professional tennis circuit today. Pandak's straps also do not interlock through the net: thus the net and net strap are not integrated with one another, and the problem with potential false "let" calls made by electronic monitoring devices remains.

Newman (U.S. Pat. No. 4,671,509) describes a net strap very similar in design to Muir (U.S. Pat. No. 4,973,055), although without the measuring device. Newman's strap is a single piece of material that is joined with a serrated buckle on one end. The other end is fed through the buckle and folded back onto itself where it is attached with a hook and loop material. The buckle plus the hook and loop work well, together as a fastener for recreational play, but in professional applications, the straps continue to slip. Like the Muir design, as well, though, the buckle is clearly visible from one side of the net. The ideal appearance sought by professional circuits worldwide has historically always been one of uniformity (both sides of the court area should be identical in appearance), with the best possible option for the net strap being a clean, white line (without visible and potentially distracting buckles). The abrasion problem with Muir's serrated buckle occurs with Newman's, as well. This device mandates an exterior measuring device, such as a tape measure or a yardstick be employed, and the height of the net must be measured with such a device each time it is checked. Newman's straps do not interlock through the net: thus the net and net strap are not integrated with one another, and the problem with potential false "let" calls made by electronic monitoring devices remains.

Robinson (U.S. Pat. No. 1,351,066) describes a net strap that is limited in use to court surfaces other than hard courts (the majority of courts in the U.S. are hard courts, such as asphalt or uhard-true," etc.), because it demands an anchoring peg and chain be driven into the court surface. Although once installed (this takes measuring with an exterior measuring device) it remains at the correct height, the strap forces the destruction of existing regulation court anchors (the standard of which are designed to accept a snap clip), and the chain is a potential distraction. The straps do not interlock through the net: thus the net and net strap are not integrated with one another, and the problem with potential false "let" calls made by electronic monitoring devices remains.

Hardy (U.S. Pat. No. 1,534,447) describes a strap and buckle for holding a tennis net to a prescribed height, but it has no integral measuring system or security systems that prevent slippage under the demands of today's professional circuit. The buckle is, again, a potential distraction. The straps do not interlock through the net: thus the net and net strap are not integrated with one another, and the problem with potential false "let" calls made by electronic monitoring devices remains.

Vaile (U.S. Pat. No. 140,997) describes a center stay for a tennis net which holds the net at 36 inches above the court provided that the court anchor depth never changes from that to which his stay was measured; his device does not allow for what are common deviations in court anchor depths. The straps do not interlock through the net: thus the net and net strap are not integrated with one another, and the problem with potential false "let" calls made by electronic monitoring devices remains.

Davis (U.S. Pat. No. 3,549,146) shows a measuring device attached to a tennis net strap anchor, but like Robinson, this device must be driven into the court surface (thus it can't be used on hard courts) and cannot be adapted to use the anchors already available on most hard and soft courts.

This self-measuring tennis net strap is unique in many ways and overcomes the problems associated with prior net strap inventions. It is adaptable to different court surfaces and anchor configurations and depths. It is easy to install and adjustable, so variances in court anchor depths and net post and cable heights are allowed for. The tab on the free end of the strap keeps the measuring end from fraying and the measuring device from deteriorating.

This self-measuring tennis net strap conforms to the ideal net strap appearance historically sought after by professional tour officials. From both sides of the net, the strap appears only as a clean, white line. The buckle and multiple hook and loop swatches, along with the strap-to-strap connectors are "hidden" inside the installed strap and offer no distraction to players. This strap is extremely durable, of negligibly or non-stretching material with a non-slipping, non-abrading buckle, preferably reinforced by two other fastening systems, in order to effect a heavy-duty strap that can withstand the demands of professional tour applications. The two sides of the installed strap are secured to one another through the net, thus integrating the strap with the net, itself. In addition to making the strap even more secure, this solves the electronic monitoring device false "let" call problem in which vibrations due to external influences other than a tennis ball are recorded, thus interrupting play or potentially influencing the outcome of a match.

BRIEF SUMMARY OF THE INVENTION

The object of the invention is to provide a durable, self-measuring tennis net strap and fastening system that quickly installs, measures, and securely holds the center of a tennis net at a certain (regulation) height above a variety of court surfaces. This strap will be suitable for professional tour applications. The strap has no visible buckles (all fasteners are "hidden" internally), and thus uniformly appears on both sides of the net as only a clean, white line. To achieve this, the tennis net strap is made of minimally or non-stretching material and employs a universal snap clip, a tab, and a non-slipping, sliding bar-buckle, and preferably has a hook and loop material as secondary and tertiary security measures. Finally another fastening system (preferably, a button) locks the two sides of the installed strap to one another through the net, which reduces net and strap movement and vibrations and reduces false calls from "let" monitoring devices due to influences other than a tennis ball striking the net.

The strap of non- or minimally stretching material (such as polyester, polyester blends, flexible carbon, or Kevlar webbing) is fastened to the center anchor in the surface of a tennis court by means of a single-ended snap clip with a slot through which the strap can slide. A metal or plastic tab is affixed to one end of the net, while a series of fasteners (buckle, button, and hook and loop) range along the strap to the other end. The tab end is pulled up one side of the net, brought over the top of the net, and then down until the tab rests against the court surface. The other end of the strap is pulled upwards from snap clip anchored to the court until the top of the net is lowered to an indicator mark sewn into the strap 36 inches (regulation tennis net height) from the end of the tab. A non-slip, non-abrading "sliding-bar" buckle and hook-and-loop swatches secure the strap together and keep it from slipping. Finally, the two sides of the strap are secured together through the net, preferably with a button (discretely placed within the folds of the installed strap) in order to reduce strap and net vibrations and thus reduce false "let" calls from "let" monitoring devices.

This net strap solves the above stated problems of prior net straps as it is designed to withstand the extreme tensions employed on net cables on professional tennis circuits, doing so with "hidden" fasteners so that the strap appears uniformly on both sides of the net as a clean, white line. It solves the false "let" call problem made by electronic monitoring devices measuring strap and net vibration and movement due to influences other than a tennis ball touching the net. The strap adapts to any height of court surface anchor and is usable above any court surface. It is easy to install, has an integral regulation height-measuring device, and is portable.

The fasteners used do not deteriorate the strap and, especially with the reinforcement of other hook-and-loop fastening elements, do not slip, thus maintaining the net at the set height for long periods of time. All previously adjustable straps slip when held to the demands of the professional circuit, or employ large, visible and thus distracting, buckles that are unsatisfactory for professional applications.

DETAILED DESCRIPTION OF THE INVENTION

Figure 1:
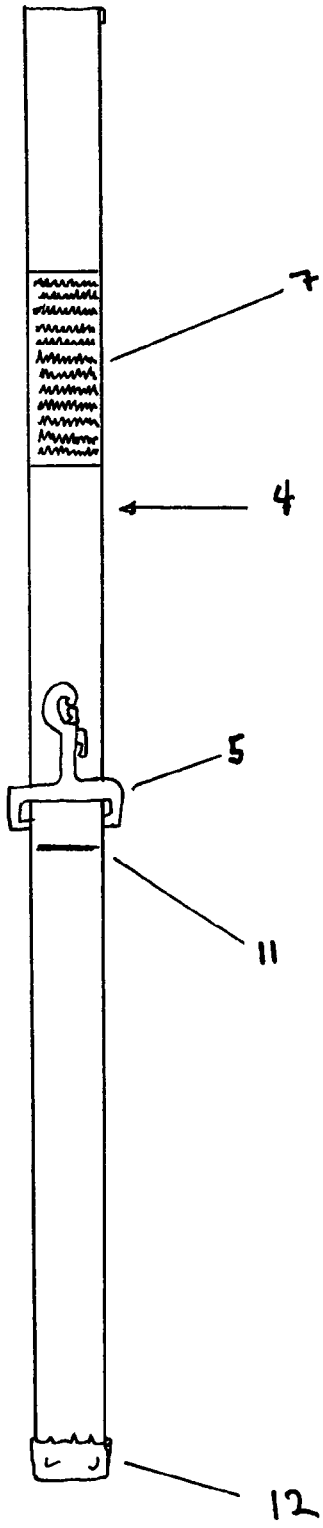
FIG. 1 is a representation of the net center strap laid flat prior to installation, showing the tab end at the bottom of the page; this view of the top of flattened strap (or outside of strap when installed) reveals the orientation of the sliding one-ended snap clip, the 36" measuring mark, and ½ of matching swatches of hook-or-loop fastening material.

A tennis net (1) is suspended between posts across a tennis court by a cable. The installed tennis net center strap (FIG. 4) adjusts and holds the center of the tennis net to regulation height (currently 36 inches) above the surface of the court (2) after being clipped to the center strap anchor (3) in the very center of the tennis court. To achieve this, the self-measuring tennis net strap (4) is made of minimally or non-stretching material and employs a single-ended snap clip (5) and a non-slipping slide-bar buckle (6). One-half of a hook-and-loop material as a secondary security measure (7) fastens to its mating one-half of hook and loop material (8) on the strap (4). Another set of hook-and-loop swatches (9, 10) is also preferably employed as well. The measuring mark (11) makes installation extremely fast and easy, and affirms the net is at the correct height, even if there is extreme variation in court surface anchors.

The strap (4) of non- or minimally stretching material, such as polyester or Kevlar webbing, is fastened to the center anchor (3) in the surface of a given tennis court (2) by means of a metal (or other durable material), single-ended snap clip (5) with a slot through which the strap (4) can slide. A metal (or plastic or nylon or other durable material) tab (12) is affixed to one end of the strap (4). The tab (12) end is pulled up one side of the net (1), brought over the top of the net (1), and down to the court surface (2).

Figure 2:
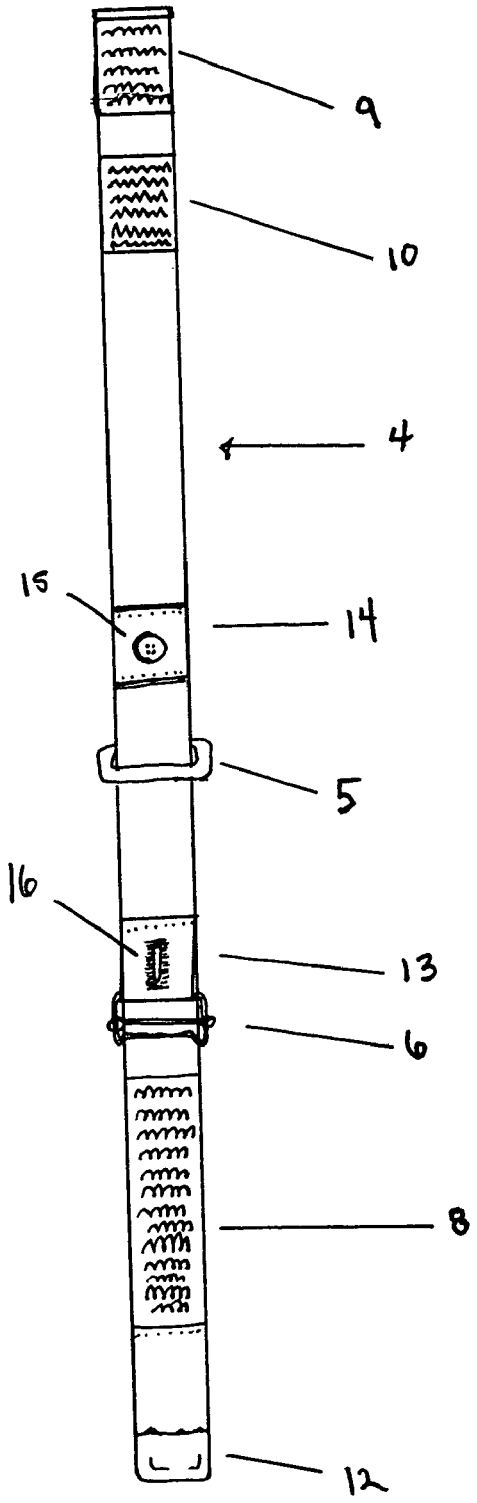
FIG. 2 is a representation of the net center strap laid flat prior to installation, showing the tab at bottom; this view of the underneath of flattened strap (or inside of strap when installed) reveals orientations of the sliding one-ended snap clip and the placement of the matching one-half of the hook and loop from the obverse view (FIG. 1). It also reveals a sewn flap of strap material below the snap clip that has a sliding-bar buckle sewn into it, and which holds a button hole for the matching button (on the fabric swatch sewn just above the shown snap dip. At the top of the displayed strap are matching hook-and-loop swatches that will straddle the sliding-bar buckle and be secured together once the strap is installed.
Figure 3:
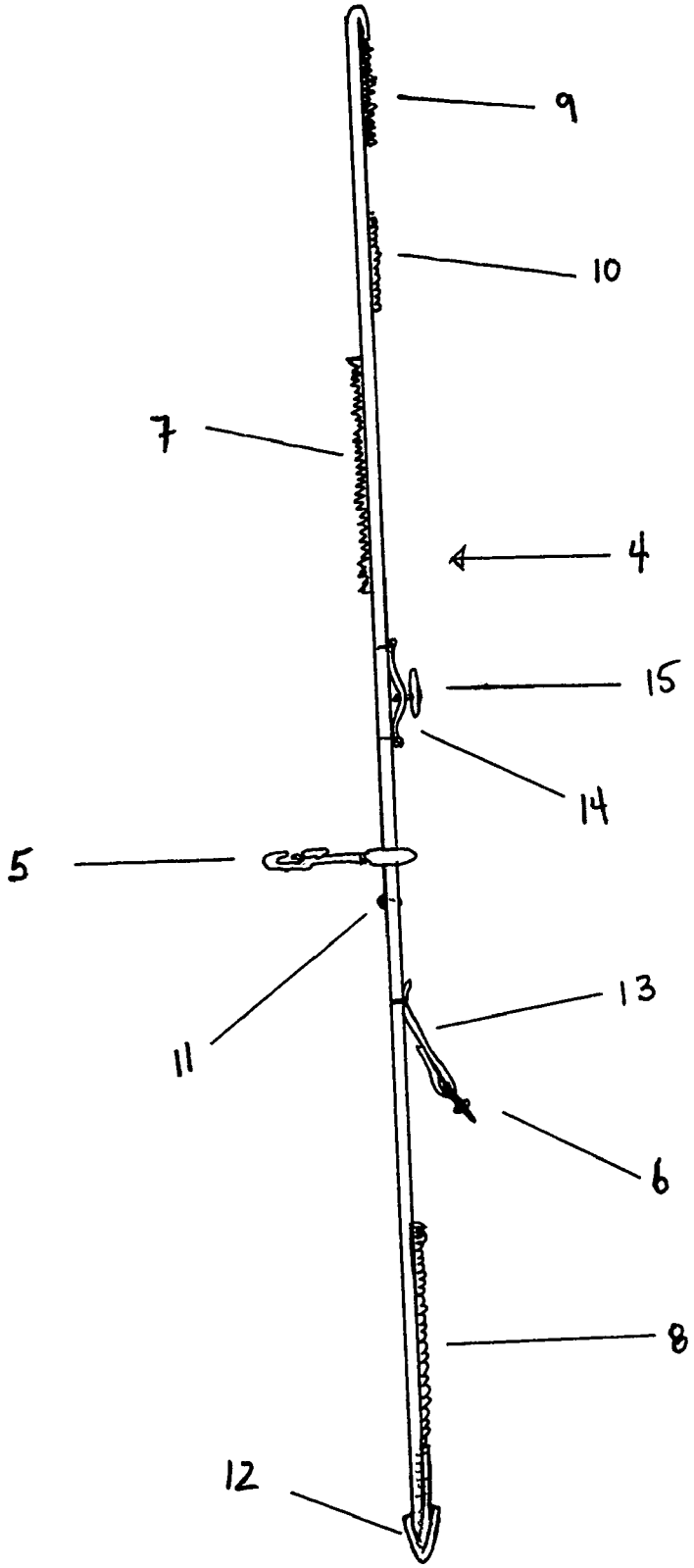
FIG. 3 is a representation of the side view of net center strap prior to installation, showing hook-and-loop swatches at top of page and tab at bottom; this view of the side of flattened reveals the orientation of the sliding one-ended snap clip, the placement of the two matching hook-and-loop swatches (four total pieces), the button swatch with button, the buckle strip with buckle and button hole (not visible).
Figure 4:
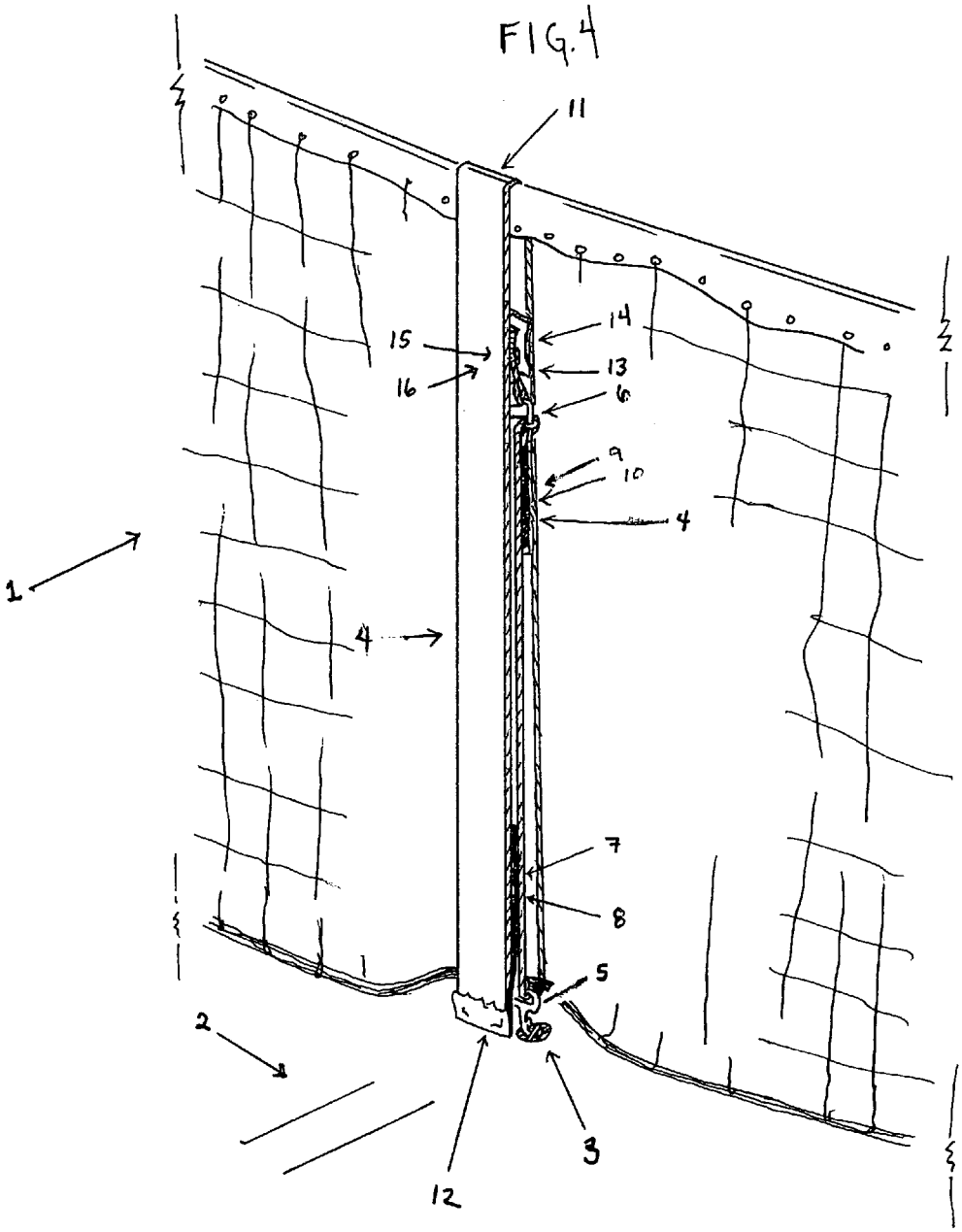
FIG. 4 is a perspective representation of the net center strap installed, with tennis net indicated by a partial drawing (net is artificially removed in drawing to see full strap); the discrete tab has been pulled to court surface, aligning the measuring mark with top of net; this view of installed strap shows the sliding one-ended snap clip snapped into court anchor, and the alignment of the buckle and button swatches, and of the swatches of hook-and-loop material. It also shows the installed strap has no visible buckles to potentially distract players.

The measuring mark (11) for checking the proper height of net becomes level with the top of the net when the non-tab end of the strap (4) is pulled up through the anchoring snap clip (5). Once the top of the net (1) is lowered to the measuring mark (11), matching hook and loop swatches (7 and 8) are pressed together just above tab (12). The non-tab end of strap (4) is pulled up to the strip of material (13) holding buckle (6), threaded through top buckle slot, around buckle bar and back down through buckle (6). The mating swatches of hook-and-loop material (9 and 10) on the underside (FIG. 2) of the strap (4) are pressed together. These are equidistant from the closed buckle (6) and aligned with one another when the strap (4) is installed (FIG. 4).

A button (15) on a short strip of material (14) sewn to the underside of strap (4) is pushed through a hole in net (1) and fastened through a button hole (16) in buckle strip (13). This integrates the strap (4) with the net (1).

It should be noted that the strap (4) width is between one-half and two and one-half inches wide, but preferably is two inches wide, and that the strap (4) may be in any color, although white or "natural" is preferred. The buckle, snap clip, and end tab may be metal, plastic, nylon, or some other durable material, and can be in a variety of colors, though one that matches or complements the strap color is preferred. The overall length of strap (4) is between 72 and 120 inches in length. The shorter strips (13, 14) should be the same width or narrower that main strap (4) and is between one and five inches in length. The hook-and-loop swatches (7, 8, 9, 10) sewn to or glued onto the strap (4) are between 2 and 24 inches in length. The sliding snap clip (5) must have a slot wide enough to allow the strap (4) to pass through it and may have a sliding bar. The measuring mark (11) should measure net height at regulation distance (currently 36 inches) from end of tab (12).

We claim:

1. A self-measuring tennis net center strap designed for professional applications that quickly sets and secures the top of the center of a tennis net at a certain (regulation) playing height (currently 36 inches) above the playing surface and which has all fastening systems "hidden" internally once installed comprising:

a strap of non- or minimally stretching material fastened to the center anchor in the surface of a tennis court by means of a single-ended snap dip with a slot through which the strap can slide, with a buckle sewn to the underside of the strap and a tab affixed to the other, so that once the clip is fastened to the court, the tab end of the strap can be pulled up one side of the net, brought over the top of the net, and pulled down until the tab just touches the court surface;

and which once the tab is thus held to the court surface and the opposite end of the strap is pulled up through the anchored snap clip, the top of the net lowers until it is level with a sewn measuring mark on the strap indicating the net is at the correct height;

and which once the net is at the correctly indicated height, matching swatches of aligning hook-and-loop material on the strap are pressed together to hold the strap while the free end of the strap is pulled up through a non-abrasive, sliding-bar buckle and back down through it to secure the strap;

and which another set of matching and aligning swatches of hook-and-loop material are pressed together just below buckle to further secure buckle;

and once the net strap is securely fastened with the buckle and hook-and-loop swatches that the strap material on both sides of the net are fastened to one another, through the net by a button or similar device so that the net and strap are integral with one another, thus reducing the potential number of false "let" calls made by electronic vibration, sound, and optical monitors;

and which installed uniformly appears from both sides of the net as a clean, white line, without any distracting buckles evident to the players.

* * * * *